US009512634B2

(12) United States Patent
Forbis

(10) Patent No.: US 9,512,634 B2
(45) Date of Patent: Dec. 6, 2016

(54) FENCE SYSTEM WITH VARIABLE RAIL REINFORCEMENT

(71) Applicant: Enduris Extrusions, Inc., Jacksonville, FL (US)

(72) Inventor: John T. Forbis, Jacksonville, FL (US)

(73) Assignee: Enduris Extrusions, Inc., Jacksonville, FL (US)

( * ) Notice: Subject to any disclaimer, the term of this patent is extended or adjusted under 35 U.S.C. 154(b) by 280 days.

(21) Appl. No.: 13/843,311

(22) Filed: Mar. 15, 2013

(65) Prior Publication Data

US 2014/0203230 A1 Jul. 24, 2014

Related U.S. Application Data

(60) Provisional application No. 61/754,928, filed on Jan. 21, 2013.

(51) Int. Cl.
*E04H 17/14* (2006.01)

(52) U.S. Cl.
CPC ..... *E04H 17/143* (2013.01); *E04H 2017/1465* (2013.01); *Y10T 29/49826* (2015.01); *Y10T 29/49833* (2015.01); *Y10T 29/49947* (2015.01)

(58) Field of Classification Search
None
See application file for complete search history.

(56) References Cited

U.S. PATENT DOCUMENTS 3,712,590 A 1/1973 Tochner et al.
3,922,828 A * 12/1975 Patton ..... E04C 3/29 52/309.2
4,188,019 A 2/1980 Meredith
4,262,882 A * 4/1981 Simcoe ..... E04H 17/1434 256/22
4,722,514 A 2/1988 Pettit
4,766,031 A * 8/1988 Kohl ..... 428/317.9
5,129,628 A 7/1992 Vesper
5,509,640 A 4/1996 Vesper
5,740,644 A 4/1998 Menchetti
5,938,184 A 8/1999 DeSouza
6,003,277 A 12/1999 Graham et al.
6,398,193 B1 6/2002 DeSouza
6,755,394 B2 6/2004 Forbis et al.
6,827,995 B2 * 12/2004 Hughes ..... B29C 47/0023 428/317.9
6,877,721 B2 4/2005 Calverley
7,032,890 B2 4/2006 Svalbe
7,258,913 B2 8/2007 Jo et al.

(Continued)

FOREIGN PATENT DOCUMENTS

CN 202181520 4/2012
FR 2615550 A1 * 11/1988 ..... E04C 3/29
KR 20040031345 4/2004

*Primary Examiner* — Matthieu Setliff
(74) *Attorney, Agent, or Firm* — Clayton, Howarth & Cannon, P.C.

(57) ABSTRACT

A fencing system that includes a plurality of fence rails extending between two fence posts. The fence rails may comprise a foamed material core that is enclosed by a weather resistant capping material. One or more hollow passageways may be formed in each of the fence rails to both reduce weight and to receive a metal reinforcing member. A plurality of fence pickets may be installed onto the fence rails using power driven fasteners, such as ring shank nails or staples.

17 Claims, 7 Drawing Sheets

(56) References Cited

U.S. PATENT DOCUMENTS

| | | | | |
|---|---|---|---|---|
| 7,934,699 | B2 * | 5/2011 | Zell et al. | E04H 17/168 256/24 |
| 7,972,546 | B1 * | 7/2011 | Hughes | B32B 27/12 264/148 |
| 8,011,278 | B1 | 9/2011 | Loper | |
| 8,197,733 | B2 * | 6/2012 | Sudano | B05C 5/0241 264/171.1 |
| 2005/0242336 | A1 * | 11/2005 | Giacchino | B29C 37/0053 256/33 |
| 2006/0202183 | A1 | 9/2006 | Terrels et al. | |
| 2007/0235705 | A1 * | 10/2007 | Burger et al. | 256/1 |
| 2010/0283022 | A1 | 11/2010 | Delafield et al. | |

* cited by examiner

FENCE SYSTEM WITH VARIABLE RAIL REINFORCEMENT

CROSS-REFERENCE TO RELATED APPLICATIONS

This application claims the benefit of U.S. Provisional Application No. 61/754,928, filed Jan. 21, 2013, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Present Disclosure

The present disclosure relates generally to fencing systems, and more particularly, but not necessarily entirely, to fencing systems that use components made from artificial materials.

2. Description of Related Art

A number of fencing products have been introduced as an alternative to wood fencing. Perhaps one of the most popular alternatives to wood fencing are fencing products that incorporate hollow PVC. Hollow PVC fencing, while a commercial success, has several drawbacks, including that it requires complex installation procedures and that it has a rather unappealing appearance. Attempts to find a better alternative to hollow PVC fencing have included investigations into the suitability of wood composite materials.

For example, composite fencing materials made of wood and plastic (polyethylene) have been used in fence product lines. However, these products have been found to be unduly heavy, making them unsuitable for some fencing applications. In particular, the weight of previously available composite fencing products caused sagging for fence rails spanning more than a few feet. In order to prevent sagging, perforated steel strips have been embedded in composite fence rails. While this approach did tend to reduce sagging, the use of reinforced composite fencing materials made of wood and plastic is still limited due to its extremely high cost.

Another previously available fencing product included a composite material made from polyethylene and wood flour. This approach used a composite as a shell over wood elements for rails and posts, but these designs were limited to short spans, such as less than six feet. Further, the methods of construction were limiting as to the styles, because the long term effects of using a wood support element have proven unsatisfactory due to moisture absorption, twisting and sagging. Stated another way, although organic materials may add strength to fencing products, organic material also adds potential failure points.

It would therefore be an improvement over the previously available composite fencing products to provide a low-cost and highly durable fencing product with no organic materials and that assembles like wood fencing in the field. That is, it would be an improvement over the prior art to provide a fencing product that contains no wood fibers but that assembles as easily as traditional wood fencing products.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
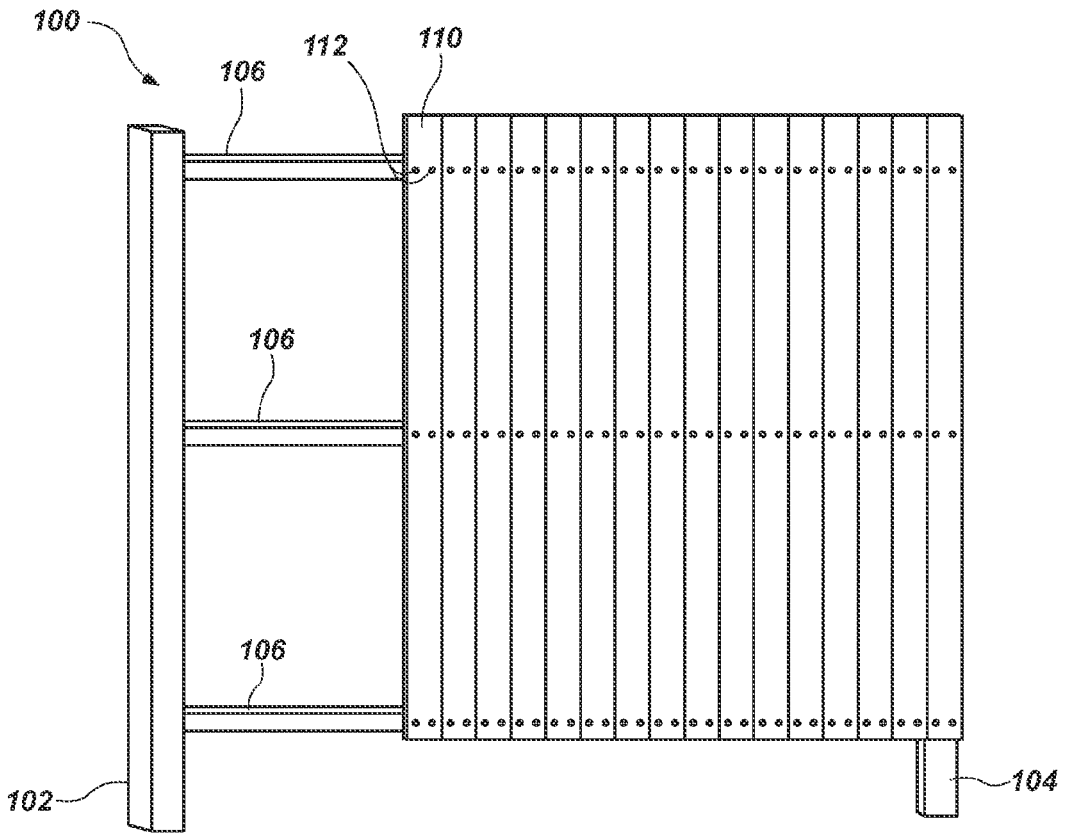
FIG. 1 is a perspective view of a segment of a fencing system pursuant to an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used herein, the singular forms "a," "an," and "the" include plural referents unless the context clearly dictates otherwise. As used herein, the terms "comprising," "including," "having," "containing," "characterized by," and grammatical equivalents thereof are inclusive or open-ended terms that do not exclude additional, unrecited elements or method steps.

As used herein, the phrase "substantially the same as" means that the items subject to the comparison are the same, except that minor variations may be present.

As used herein, the term "about," when used in reference to a stated value, means within 15% of the stated value.

As used herein, the term "foamed material" may refer to a material that has been expanded, typically with gas or chemical blowing agents, to produce a lightweight or reduced density version of the material, usually through an extrusion process. Examples of foamed materials include, without limitation, foamed plastics, cellular polyvinyl chloride (PVC), foamed thermoplastics, foamed inorganic material, and foamed polyethylene.

Applicant has invented and confirmed the benefits of a low-cost and durable fencing system as an alternative to composite fencing systems. Applicant's fencing system may include extruded fence rails and pickets comprising a foamed material. To reduce weight, the fence rail may include a pair of spaced apart, hollow passageways extending along the entire longitudinal length of the fence rail. A reinforcing member may be disposed within one or both of the hollow passageways to eliminate deflection, e.g., sagging, in the fence rail due to environmental factors, such as heat, wind, wear or weight, including the adverse effects of freeze and thaw cycles. The reinforcing member may be a metal tubular member (aluminum or steel), formed from welding, rolling, extrusion or the like. In an embodiment, the reinforcing member may be formed from a non-metal substance, including fiberglass, plastic, or any other inorganic material.

Power driven fasteners, such as ring shank nails, nails or staples, may be utilized to secure the fence pickets to the rails such that Applicant's fencing system may be installed similar to traditional wood fencing. Applicant's fencing system is particularly suited to span distances greater than six feet between fence posts.

Referring now to FIG. 1, a segment of a fencing system, designated generally at 100, includes a first post 102 and a second post 104. The first post 102 and the second post 104 may be mounted in the ground using any method known to one having skill in the art. For example, the first post 102 and the second post 104 may be installed into post holes that are then backfilled with dirt or cement. In an embodiment, the first post 102 and the second post 104 may be formed of vinyl. In an embodiment, the first post 102 and the second post 104 may be formed of metal or wood.

Extending horizontally between the posts 102 and 104 may be fence rails 106. The rails 106 may comprise a top rail, a middle rail, and a bottom rail. The ends of the rails 106 may be coupled the fence posts 102 and 104. In an embodiment, the ends of the rails 106 are installed into slots (not shown) in the fence posts 102 and 104. In an embodiment, the ends of the rails 106 are secured to the fence posts 102 and 104 using fasteners. In an embodiment, the ends of the rails 106 are secured to the fence posts 102 and 104 using brackets. In an embodiment, the ends of the rails 106 are secured to the fence posts 102 and 104 using clips. Thus, it will be appreciated that the fence rails 106 may be coupled to the fence posts 102 and 104 by various means, all of which are in the scope of the present disclosure.

A plurality of fence pickets 110 may be installed onto the fence rails 106. It will be appreciated that the plurality of fence pickets 110 may extend between the first post 102 and the second post 104; although in FIG. 1 some of the fence pickets 110 are not shown in order to show the features of the present invention. The fence pickets 110 may be secured to the fence rails 106 using fasteners 112, such as ring shank nails, nails, screws, staples, or the like. In an embodiment, two fasteners 112 may be utilized to secure a fence picket 110 to each of the fence rails 106. In an embodiment, the fasteners 112 may be installed using a powered driving device, such as a nail or staple gun.

Figure 2:
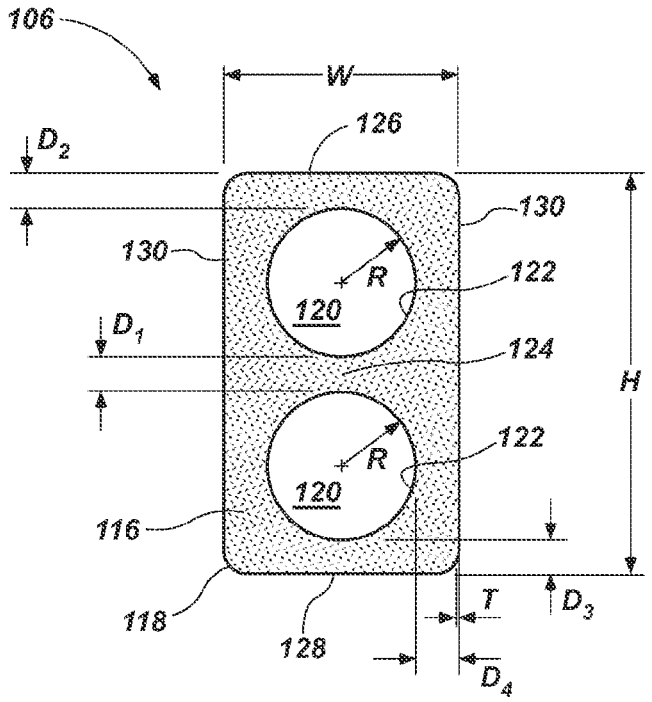
FIG. 2 is a cross-sectional view of a fence rail of the fencing system shown in FIG. 1.

Referring now to FIG. 2, there is shown a cross-sectional shape of a fence rail 106. In an embodiment, the interior of the fence rail 106 may comprise a core 116 formed from a foamed material. Disposed around the core 116 may be a cap 118. It will be appreciated that the cap 118 may be more weather resistant than the core 116. In an embodiment, the cap 118 may comprise PVC or ASA (acrylonitrile/styrene/acrylate).

In an embodiment, the cap 118 may be heat embossed with an aesthetically pleasing pattern, such as a wood grain pattern. In an embodiment, the foamed material used in the core 116 may have a weight of 0.01 to 0.04 pounds per cubic inch. In an embodiment, the thickness, T, of the cap 118 may be between 0.005 and 0.025 inches, or about 0.012 inches.

As shown, the cross-sectional shape of the fence rail 106 may be rectangular. In an embodiment, the cross-sectional shape of the fence rail 106 may be some shape other than rectangular. In an embodiment, a height, H, of the fence rail 106 may be between 2.5 inches and 6.0 inches. In an embodiment, the height, H, may be about 2.75 inches. In an embodiment, a width, W, of the fence rail 106 may be between 1.0 inch and 3.0 inches. In an embodiment, the width, W, of the fence rail 106 may be about 1.625 inches.

Disposed within an interior of the fence rail 106 may be a pair of spaced apart, hollow passageways 120 that extend along a length of the fence rail 106 between the first post 102 and the second post 104 (see FIG. 1). In an embodiment, the hollow passageways 120 extend along the entire length of the fence rail 106. In an embodiment, the hollow passageways 120 do not extend along the entire length of the fence rail 106. Each of the hollow passageways 120 may be defined by an annular interior sidewall 122 formed in the core 116. Each of the hollow passageways 120 may be formed by a continuous, unbroken annular interior sidewall 122 that thereby completely circumferentially encloses passageway 120. In the latter case, it is to be understood that any item residing within a passageway 120 would thereby, in the instance last mentioned in the prior sentence, be encapsulated if opposing ends of the passageway 120 were closed, and accordingly, the phrase "circumferentially encapsulated" shall refer to that condition of an item, such as a reinforcing member 152, being completely circumferentially enclosed, regardless of whether opposing ends of the passageway 120 are closed or not. In an embodiment, an item, such as a reinforcing member 152, residing within a passageway 120 may only be partially encapsulated.

In an embodiment, a radius, R, of the hollow passageways 120 may between 0.2 inches and 1.5 inches. In an embodiment, the radius, R, of the hollow passageways 120 may be about 0.5 inches, or just slightly larger than 0.5 inches. In an embodiment, the radius, R, of one of the hollow passageways 120 may be different from the radius, R, of the other one of the hollow passageways 120.

As observed in FIG. 2, the hollow passageways 120 may be vertically stacked, with one above the other. In addition, the hollow passageways 120 may be disposed opposite sides of a center 124 of the fence rail 106. In an embodiment, a distance, $D_1$, between the hollow passageways may between 0.15 inches and 1.5 inches, or about 0.2380 inches. Thus, a thickness of the foamed material between the hollow passageways 120 may be between 0.15 inches and 1.5 inches, or about 0.2380 inches.

In an embodiment, a distance, $D_2$, between the top hollow passageway 120 and a top wall 126 of the fence rail 106 may be between 0.15 inches and 0.75 inches, or about 0.2360 inches. Likewise, a distance, $D_3$, between the bottom hollow passageway 120 and a bottom wall 128 of the fence rail 106 may be between 0.15 inches and 0.75 inches, or about 0.2360 inches. In an embodiment, a distance, $D_4$, between the hollow passageways 120 and sidewalls 130 of the fence rail 106 may be between 0.2 inches and 1.5 inches, or about 0.3025 inches.

Although the hollow passageways 120 in the interior of the fence rail 106 are depicted as having circular cross-sections, it will be appreciated that the cross-sections may be non-circular. In an embodiment, the cross-sections of the hollow passageways 120 may be oval. In an embodiment, the cross-sections of the hollow passageways 120 may be rectangular or square. In an embodiment, the cross-sections of the hollow passageways 120 may be I-beam shaped.

Figure 3:
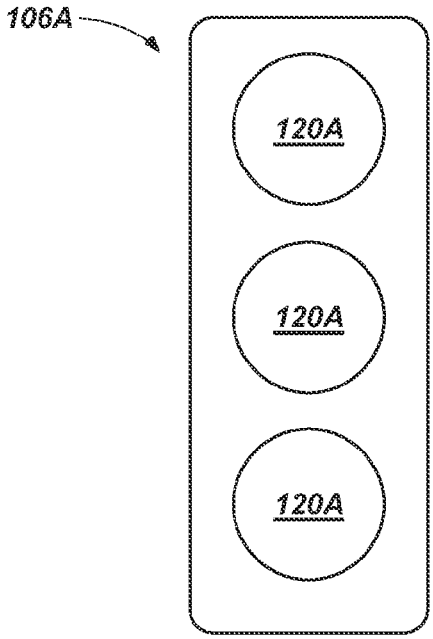
FIG. 3 is a cross-sectional view of a fence rail pursuant to an embodiment of the present disclosure.
Figure 4:
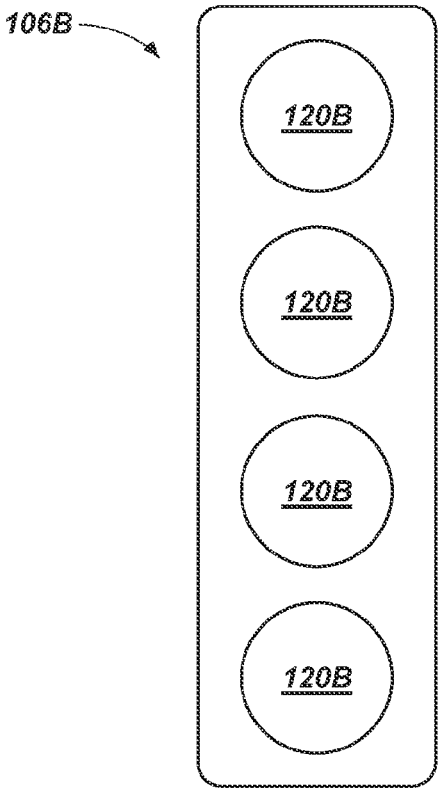
FIG. 4 is a cross-sectional view of a fence rail pursuant to an embodiment of the present disclosure.

It will be appreciated that a fence rail according to the present disclosure may have more, or less than, two hollow passageways formed therein. For example, as shown in FIG. 3, there is shown an embodiment of a fence rail 106A comprised of a foamed material having three hollow passageways 120A formed therein. And, as shown in FIG. 4, there is shown an embodiment of a fence rail 106B comprised of a foamed material having four hollow passageways 120B formed therein. In an embodiment, a fence rail may have single hollow passageway formed therein. Thus, it will be appreciated that the present invention is not limited to any number of hollow passageways in the interior core of a fence rail.

Due to the inherent weakness of a foamed material, and the presence of the hollow passageways, the fence rails may deform due to solar heat buildup or high wind conditions without additional reinforcement to increase their stiffness. Accordingly, the present disclosure may include adding reinforcing members into the hollow passageways as will now be explained.

Figure 5A:
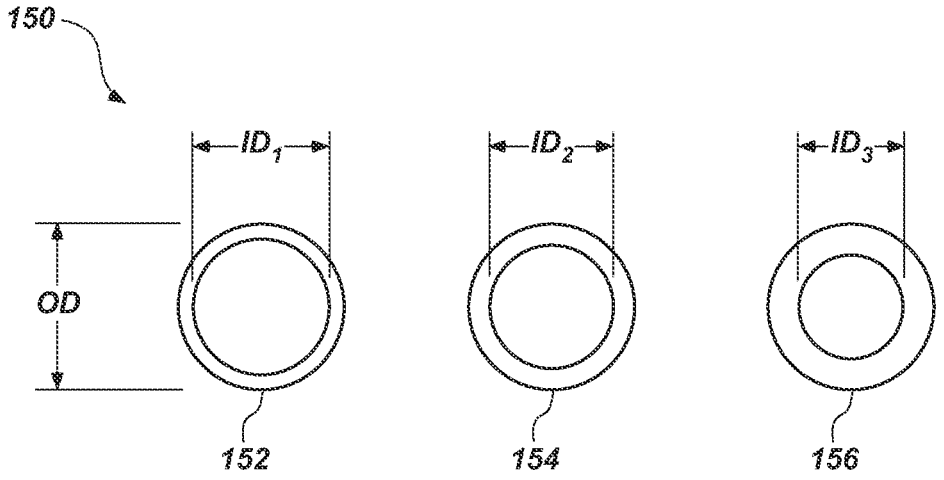
FIG. 5A depicts cross-sectional views of a set of fence rail reinforcing members pursuant to an embodiment of the present disclosure.

Referring now to FIG. 5A, there is depicted a cross-sectional view of a set 150 of reinforcing members 152, 154 and 156. It will be appreciated that each of the set 150 is configured and adapted to be installed into the hollow passageways 120 of the fence rail 106. In an embodiment, each of the set 150 has a different stiffness as compared to the other ones of the set 150 in order to provide a range of selectable stiffness enhancements for the fence rail 106.

In an embodiment, each of the set 150 may be an elongated tubular member formed from a stiff material such as metal. In an embodiment, the metal may be steel or aluminum. For example, each of the set 150 may be formed from welded or rolled steel. In an embodiment, each of the set 150 may be formed of extruded aluminum. In an embodiment, each of the set 150 may be formed from a inorganic material. In an embodiment, each of the set 150 may be formed from a non-metal substance, including fiberglass, plastic, glass fibers, resins, or any other inorganic material with the desired stiffness.

In an embodiment, each of the set 150 may have substantially the same outer diameter, OD, as the other members of the set 150. The outer diameter, OD, of each of the set 150 may be just slightly smaller than the diameter of the hollow passageways 120 of the fence rail 106. The inner diameters of each of the set 150 may vary in order to provide a selectable range of stiffness. In an embodiment, the outer diameter, OD, may be between 0.5 inches to 2.5 inches.

For example, in FIG. 5, the reinforcing member 152 may have an inner diameter, $ID_1$, the reinforcing member 154 may have an inner diameter, $ID_2$, and the reinforcing member 156 may have an inner diameter, $ID_3$, such that $ID_1<ID_2<ID_3$. Stated another way, a wall thickness of each of the members of the set 150 may vary in order to provide a selectable range of stiffness in the reinforcement members.

In an embodiment, a fence installer may select one of the set 150 to match the expected conditions at the site of installation. For example, in locations with high winds, the installer may select the member of the set 150 with the highest stiffness rating, typically the one of reinforcing members with the thickest wall. The installer may install the selected reinforcing member into one of the hollow passageways 120 of the fence rail 106 prior to assembling the fence. This installation procedure may also be performed by the manufacturer prior to shipment based upon the local where the fence will be installed. Further, it will be appreciated that a reinforcing member may be installed in one or both of the hollow passageways 120 in the fence rail 106. It will be appreciated the set 150 may include any number of reinforcing members to provide a range of stiffness variation.

Figure 5B:
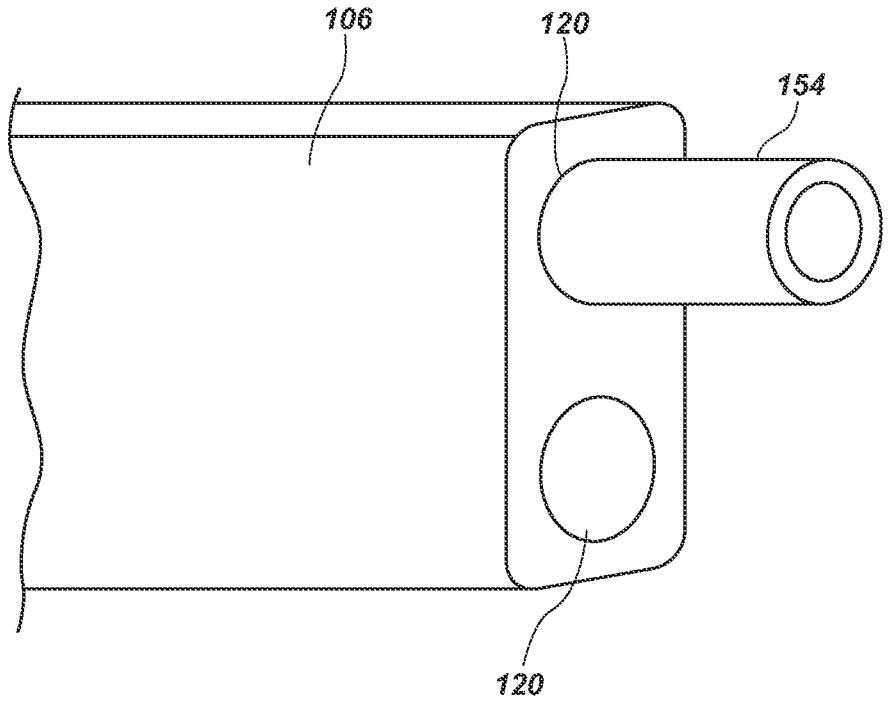
FIG. 5B depicts a fragmentary view of a fence rail with a reinforcing member partially inserted into a top one of a pair of hollow passageways.

Referring now to FIG. 5B, there is depicted an end the fence rail 106 having the reinforcing member 154 partially installed into the top one of the hollow passageways 120. Once fully installed, the ends of the reinforcing member 154 may be flush with the ends of the fence rail 106 such that the reinforcing member 154 extends along the entire length of the fence rail 106. In an embodiment, the ends of the reinforcing member 154 may extend beyond the ends of the fence rail 106. In an embodiment, the ends of the reinforcing member 154 may terminate short of the ends of the fence rail 106.

In an embodiment, the outer diameter of the reinforcing member 154 may be just slightly smaller than the diameter of the hollow passageway 120 to thereby provide a snug fit. A reinforcing member may be installed in one or both of the hollow passageways 120. It will be appreciated that any of the set 150 may replace the reinforcing member 154.

In an embodiment, the reinforcing member 154 may be manually installed into the fence rail 106 onsite. The installer may utilize a tool, such as a hammer, to tap the reinforcing member 154 into the hollow passageway. The installer may select the reinforcing member 154 from the set 150 (FIG. 5A) in order to match the stiffness of the reinforcing member 154 to the local conditions. In an embodiment, the reinforcing member 154 may be installed off-site by a manufacturer.

Figure 6:
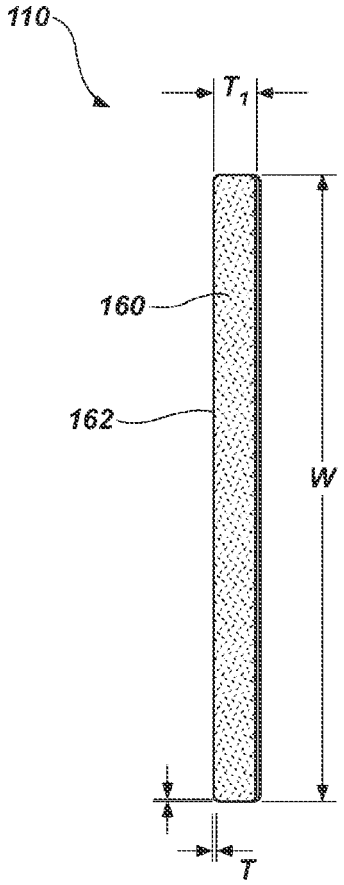
FIG. 6 is a cross-sectional view of a fence picket pursuant to an embodiment of the present disclosure.

Referring now to FIG. 6, there is shown a cross-sectional view of a fence picket 110 according to an embodiment of the present disclosure. In an embodiment, a core 160 of the fence picket 110 may comprise a foamed material. Disposed around the core 160 may be a cap 162. In an embodiment, the cap 162 may be heat embossed with an aesthetically pleasing pattern, such as a wood grain pattern. In an embodiment, the foamed material may have a weight of 0.025 pounds per cubic inch. In an embodiment, the thickness, T, of the cap 162 may be between 0.015 and 0.025 inches, or about 0.020 inches.

As shown, the cross-sectional shape of the fence picket 110 may be rectangular. In an embodiment, the cross-sectional shape of the fence rail 110 may be some shape other than rectangular. In an embodiment, a width, W, of the fence picket 110 may be between 3.0 inches and 8.0 inches.

In an embodiment, the width, W, may be about 5.5 inches. In an embodiment, a thickness, $T_1$, of the fence picket 110 may be between 0.25 inches and 0.75 inches, or about 0.412 inches.

Figure 7:
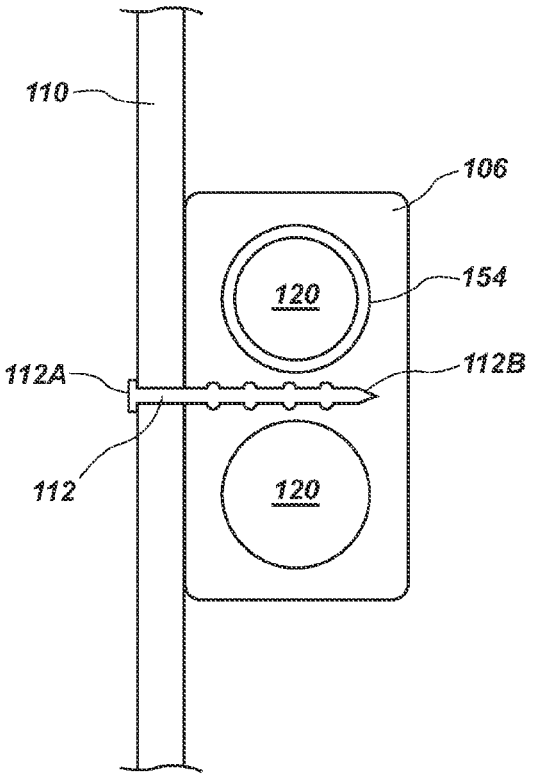
FIG. 7 is a fragmentary, cross-sectional view of a fence rail and fence picket pursuant to an embodiment of the present disclosure.

Referring now to FIG. 7, there is depicted a cross-sectional view of a fence rail 106 having a fence picket 110 mounted thereon. A reinforcing member 154 may be installed in the top one of the hollow passageways 120. A fastener 112 may be utilized to secure the picket 110 to the fence rail 106. The fastener 112 may include a head 112A and a shaft 112B, where the shaft 112B of the fastener 112 may extend into, and beyond, the foamed material between the hollow passageways 120. In an embodiment, the fastener 112 may be one of a ring shank nail, a staple, or standard nail. In an embodiment, the fastener 112 may be installed using a powered tool, such as a nail or staple gun. It will be appreciated that the ability to use a powered tool greatly reduces the installation time of the fence pickets 110.

Figure 8:
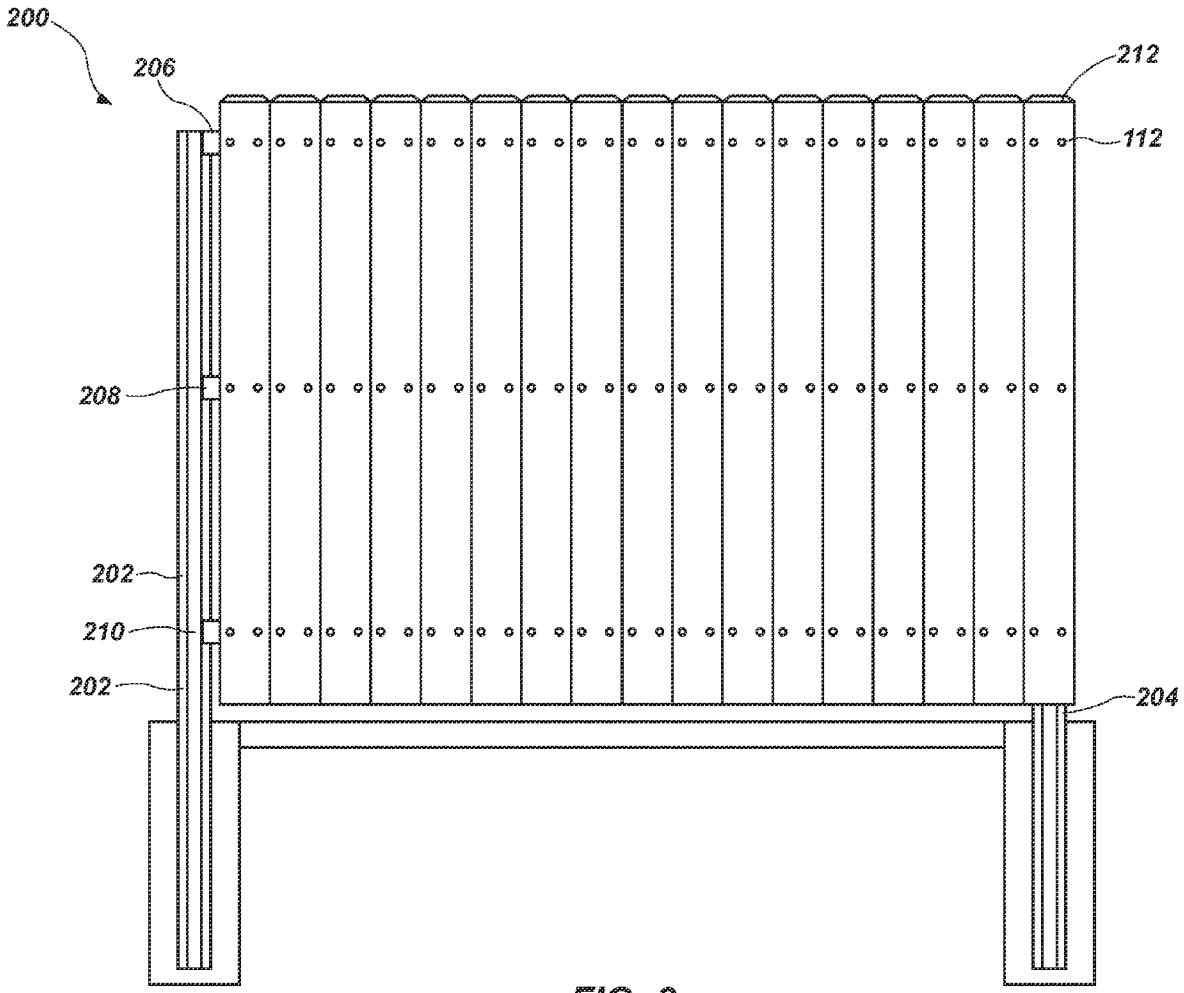
FIG. 8 is a view of a fence segment pursuant to an embodiment of the present disclosure.

Referring now to FIG. 8, there is depicted a fence section 200 according to an embodiment of the present disclosure. The fence section 200 may comprise a pair of fence posts 202 and 204 installed into the ground. The fence posts 202 and 204 may be steel posts that are about 8 feet long. A top fence rail 206, a middle fence rail 208, and a bottom fence rail 210 may extend between the fence posts 202 and 204. The fence rails 206, 208, and 210 may take the same form as the fence rail 106, described above.

In an embodiment, the fence rails 206, 208, and 210 may be about 5 feet to 10 feet long, or about 93.75 inches long. The fence rails 206, 208, and 210 may be secured to the fence posts 202 and 204 in a wide variety of manners. In an embodiment, the ends of the fence rails 206, 208, and 210 may be installed into slots in the fence posts 202 and 204. In an embodiment, the fence rails 206, 208, and 210 may be installed onto the fence posts 202 and 204 using brackets.

Reinforcing members may be installed into hollow passageways in the fence rails 206, 208, and 210 in order to increase the stiffness of the fence rails 206, 208, and 210. In an embodiment, only one of the fence rails 206, 208, and 210, such as the middle fence rail 208, may have a reinforcing member installed therein. In an embodiment, any two of the fence rails 206, 208, and 210 may have a reinforcing member installed therein. In an embodiment, all of the fence rails 206, 208, and 210 may have a reinforcing member installed therein.

A plurality of dog ear fence pickets 212 may be installed onto the fence rails 206, 208, and 210 using fasteners 112. In an embodiment, the fasteners 112 may be installed using a power tool, such as a nail or staple gun. In an embodiment, the pickets 212 may be between 3 feet and 12 feet long, or about 70 inches.

Figure 9:
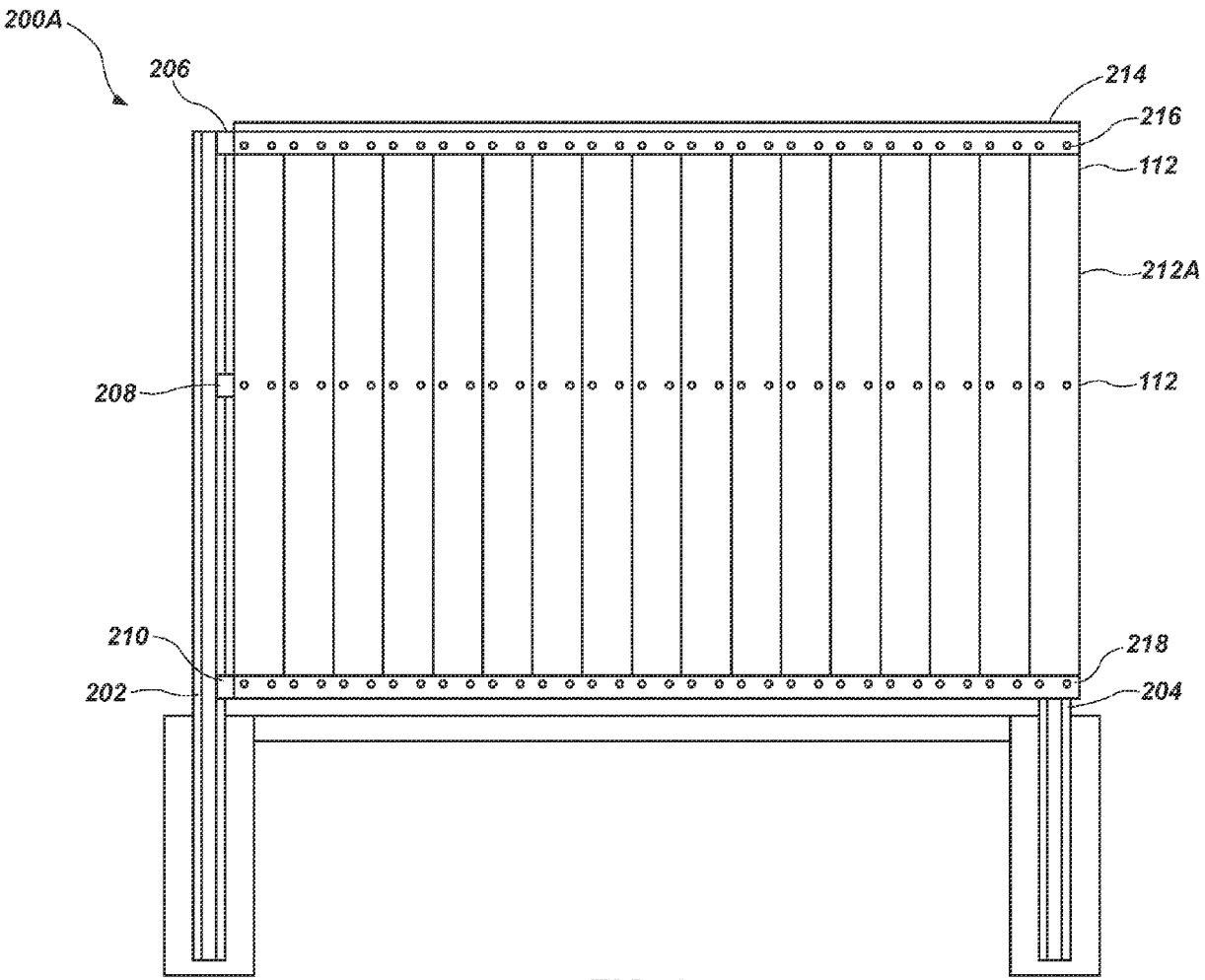
FIG. 9 is a view of a fence segment pursuant to an embodiment of the present disclosure.

Referring now to FIG. 9, there is depicted a California style fence section 200A according to an embodiment of the present disclosure, where like reference numerals depict like components to those in FIG. 8. In FIG. 9, instead of the pickets 212 as shown in FIG. 8, pickets 212A are installed onto the fence rails 206, 208, and 210 by fasteners 112. A deck board 214 may be disposed across the top of the fence pickets 212A. In an embodiment, the deck board 214 may have dimensions of 1 inch×5.5 inches×92.25 inches. In an embodiment, the deck board 214 may have a length between 10 to 20 feet.

A top front board 216 may be installed at the top of the pickets 212A and just below the deck board 214. A bottom front board 218 may be installed at the bottom of the pickets 212A. In an embodiment, the top front board 216 and the bottom front board 218 may have dimensions of 0.425 inches×2.75 inches×92.25 inches. The deck board 214, the top front board 216, and the bottom front board 218 may be formed from an extrusion process and comprise capped foamed material.

Referring now back to FIG. 1, a method of installing a fence section according to an embodiment of the present disclosure will be described. The method may include installing fence posts 102 and 104 into the ground. This may be accomplished by digging post holes either by hand or by a machine. These holes may be backfilled using backfill, such as dirt or cement. In an embodiment, the distance between the centers of the fence posts may be greater than one of six feet, seven feet, or eight feet. In an embodiment, the distance between the centers of the fence posts may be about eight feet. The fence posts 102 and 104 may comprise metal, wood, or vinyl.

Once the fence posts 102 and 104 are in place, the fence rails 106 may be installed onto the fence posts 102 and 104. In an embodiment, the ends of the fence rails 106 may be inserted into slots in the fence posts 102 and 104. In an embodiment, brackets may be utilized to secure the fence rails 106 to the fence posts 102 and 104. In an embodiment, fasteners may be utilized to secure the fence rails 106 to the fence posts 102 and 104.

In an embodiment, prior to installing the fence rails 106 onto the posts 102 and 104, a reinforcing member may be installed into a hollow passageway of one of the fence rails 106. In an embodiment, a reinforcing member is installed into all of the fence rails 106. In an embodiment, a reinforcing member is installed into two of the fence rails 106. Next, a plurality of fence pickets 110 are secured to the fence rails 106. In an embodiment, the fence pickets 110 are secured to the fence rails 106 using fasteners 112. The fasteners 112 may be installed using a power tool, such as a pneumatic gun.

Figure 10:
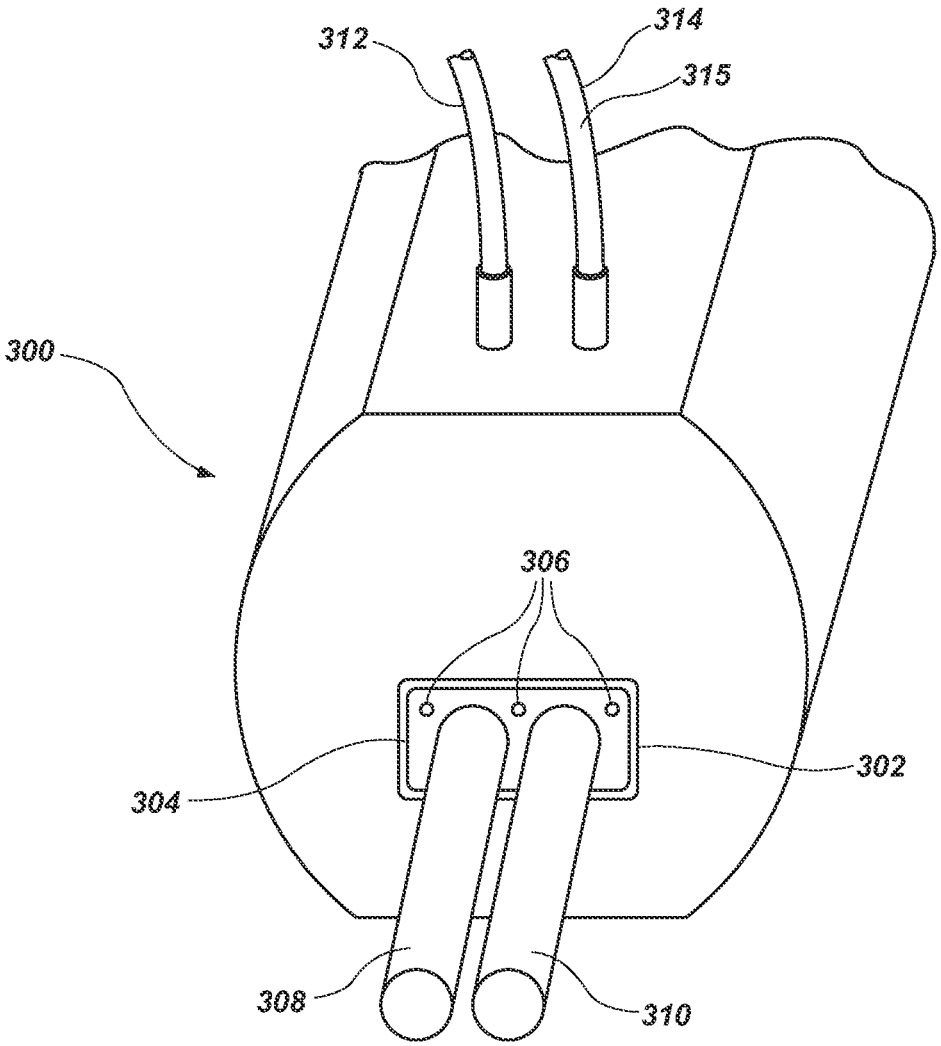
FIG. 10 is a view of a co-extrusion die for forming a fence rail having hollow passageways formed therein.

Referring now to FIG. 10, there is depicted a co-extruding apparatus 300 for creating fence rails and other elongated members with fixed cross-sections according to an embodiment of the present disclosure. The apparatus 300 operates to co-extrude both the cap 118 and the foam core 116 (see those elements in FIG. 2), simultaneously, and may comprise an extrusion die 302. The extrusion die 302 may include an outer perimeter orifice 304 (shown in the form of a thin rectangular opening) for extruding a cap, such as cap 118 of FIG. 2. The extrusion die 302 may further include areas 306 for extruding a foamed core (item 116 in FIG. 2) that is encapsulated by the cap (118 in FIG. 2). The areas 306 can be any suitable extrusion opening known to those of ordinary skill the art. Extending from the die 302 may be a first mandrel 308 and a second mandrel 310. The first mandrel 308 and the second mandrel 310 may form hollow passageways in the foamed core (item 116 of FIG. 2) as it is extruded from the die 302. A coolant 315 may be circulated through the mandrels 308 and 310 using a coolant supply line 312 and a coolant return line 314. Thus, the mandrels 308 and 310 may form and cool hollow passageways in the extrusions.

An exemplary process of forming an extrusion, e.g., a fence rail or other elongated foam member, with a core formed of a foamed material and internal hollow passageways will now be described. The process may utilize the co-extruding apparatus 300 shown in FIG. 10. The process may include a foaming extrusion process as is known to those of ordinary skill in the art, such as the Celuka process or a free foam process. The process may include extruding two extruders through the co-extruding apparatus 300. The main extruder may be an inorganic material, such as plastic, that has blowing agent introduced on line to create the foamed material core. The second extruder may introduce the cap material, e.g., a weather resistant cap of PVC or ASA, to encapsulate the foamed material core. The cap material may then be heat embossed to add a woodgrain finish to the surface of the extrusion. The finished extrusion may have two hollow passageways extending along its length. The mandrels 308 and 310 each form an inner surface that defines a hollow passageway through the extrusion. The coolant circulated through the mandrels 308 and 310 helps cool and shape the hollow passageways. Once the extrusion has cured, a reinforcing member may be inserted into one or more of the hollow passageways.

Those having ordinary skill in the relevant art will appreciate the advantages provided by the features of the present disclosure. For example, it is a feature of the present disclosure to provide an extruded foam fence rail that may have pickets attached to the rail with power driven fasteners, such as a ring shank nail or staples. The extruded foam fence rail disclosed herein may hold the fasteners with at least the same holding strength as wood.

Another feature of the present disclosure is to provide such a fence rail with a foamed material core with a weather resistant cap of PVC or ASA (acrylonitrile/styrene/acrylate) or other high performance cap that achieves superior holding strength for fasteners combined with improved weatherability.

It is a further feature of the present disclosure, in accordance with one aspect thereof, to provide an extruded fence rail formed of a foamed material with one or more hollow passageways therein, the passageways creating a chamber that is able to receive a reinforcing member. The foamed material is critical to the fence system according to the present disclosure, for several reasons, including: to reduce weight compared to previously available materials such as composite fencing, wood and plastic; to enable a fence rail having less weight per linear foot to thereby inhibit or avoid deformation such as twisting or sagging, even in larger spans between posts, such as eight foot spans or longer; to inhibit or avoid moisture absorption, which is a drawback of fencing made from organic materials; to inhibit or avoid complex installation procedures, such as required when assembling plastic or vinyl fencing which often require complex additional components such as clips, brackets, attachment hardware, in that fencing made from a foamed material will adhere to and "grab" a screw, nail or other invasive fastener that is inserted into the material. Stated another way, a foamed material as described herein brings some of the advantages of organic material (e.g. wood), such as receiving invasive fastener without undue backout, while avoiding some of the disadvantages described above in connection with the prior art. These and other advantages result from the criticality of the unique combination of features of the present disclosure, in particular, the use of foamed material in the construction of the rails, pickets, and any other components suitable for a foamed material construction.

It is further a feature of the present disclosure to provide a set of reinforcing members that provides a variable stiffness selection for the fence rails. It is further a feature of the present disclosure to provide one or more reinforcement members each comprising a seamless steel tube.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A modular fence system comprising:

a plurality of fence pickets;

a pair of fence posts;

a first fence rail extending horizontally between the fence posts, the first fence rail comprising a core formed of a foamed material, a cap enclosing the core, and a pair of spaced apart, hollow passageways formed in the core and extending along a longitudinal length of the first fence rail;

a plurality of ring-shank nails securing the plurality of fence pickets to the first rail, each of the plurality of ring-shank nails having a shaft extending through one of the fence pickets and into the foamed material of the core of the first fence rail between the pair of hollow passageways; and a reinforcing member having an annular cross-section, the reinforcing member disposed in at least one of the hollow passageways of the first fence rail.

2. The modular fence system of claim 1, wherein an outside diameter of the reinforcing member is smaller than a diameter of the hollow passageways.

3. The modular fence system of claim 1, wherein the reinforcing member is removably disposed in at least one of the hollow passageways of the first fence rail.

4. A modular fence system comprising:

a plurality of fence pickets;

a pair of fence posts;

a first fence rail extending horizontally between the fence posts, the first fence rail comprising a core formed of a foamed material, a cap enclosing the core, and a pair of spaced apart, hollow passageways formed in the core and extending along a longitudinal length of the first fence rail;

a reinforcing member disposed in at least one of the hollow passageways of the first fence rail;

wherein the reinforcing member is tubular in shape;

wherein the tubular reinforcing member has an annular cross-section; and a plurality of fasteners securing the plurality of fence pickets to the first rail, each of the plurality of fasteners having a shaft extending through one of the fence pickets and into the foamed material of the core of the first fence rail between the pair of hollow passageways;

wherein the fasteners are ring shank nails.

5. The modular fence system of claim 4, wherein the reinforcing member comprises one of metal, steel, aluminum, fiberglass, plastic, and an inorganic material.

6. The modular fence system of claim 4, wherein a distance between the two hollow passageways is between 0.15 inches and 1.5 inches.

7. The modular fence system of claim 6, wherein a distance between the two hollow passageways is about 0.2380 inches.

8. The modular fence system of claim 4, wherein one of the hollow passageways is disposed on either side of a center of the first fence rail.

9. The modular fence system of claim 4, wherein the hollow passageways have a circular cross-section.

10. The modular fence system. of claim 4, further comprising a second fence rail extending between the fence posts, the second fence rail having a pair of spaced apart, hollow passageways extending along a length of the second fence rail, wherein the plurality of fence pickets are secured to the second fence rail by fasteners.

11. The modular fence system of claim 4, further comprising a third fence rail extending between the fence posts, the third fence rail haying a pair of spaced apart, hollow passageways extending along a length of the third fence rail, wherein the plurality of fence pickets are secured to the third fence rail by fasteners.

12. The modular fence system of claim 4, wherein the foamed material is cellular PVC.

13. The modular fence system of claim 4, wherein the fence pickets comprise a foamed material.

14. The modular fence system of claim 4, wherein the first fence rail further comprises an embossed cap enclosing the core.

15. The modular fence system of claim 4, wherein the hollow passageways are configured and dimensioned to be larger in width than the reinforcing member.

16. The modular fence system of claim 4, wherein an outside diameter of the reinforcing member is smaller than a diameter of the hollow passageways.

17. A modular fence system comprising:

a pair of fence posts;

a plurality of extruded fence pickets, each of the fence pickets comprising a core formed of a foamed material and a capping material enclosing the core;

an extruded top fence rail extending horizontally between the fence posts, the top fence rail comprising a core formed of a foamed material and a cap formed over the core, the core of the top fence rail having a pair of spaced apart, hollow passageways extending along a longitudinal length of the top fence rail;

an extruded middle fence rail extending horizontally between the fence posts, the middle fence rail comprising a core formed of a foamed material and a cap formed over the core, the core of the middle fence rail having a pair of spaced apart, hollow passageways extending along a longitudinal length of the middle fence rail;

an extruded bottom fence rail extending horizontally between the fence posts, the bottom fence rail comprising a core formed of a foamed material and a cap formed over the core, the core of the bottom fence rail having a pair of spaced apart, hollow passageways extending along a longitudinal length of the bottom fence rail;

a plurality of fasteners securing the plurality of fence pickets to the top fence rail, the middle fence rail, and the bottom fence rail, each of the plurality of fasteners having a shaft extending through one of the fence pickets and into the foamed material of the core between the pair of hollow passageways of one of the top fence rail, the middle fence rail, and the bottom fence rail;

a metal and tubular reinforcing member having an annular cross-section, the reinforcing member disposed in at least one of the hollow passageways of one of the top fence rail, the middle fence rail, and the bottom fence rail;

wherein a cross-section of the hollow passageways in each of the top fence rail, the middle fence rail, and the bottom fence rail is circular;

wherein a diameter of the hollow passageways in each of the top fence rail, the middle fence rail, and the bottom fence rail is about 1 inch;

wherein a separation between the two hollow passageways in each of the top fence rail, the middle fence rail, and the bottom fence rail is between 0.15 inches and 1.5 inches;

wherein the fasteners are ring shank nails;

wherein a distance spanned by the top fence rail, the middle fence rail, and the bottom fence rail is greater than 7 feet.

* * * * *